US010909911B1

(12) United States Patent
Zheng et al.

(10) Patent No.: US 10,909,911 B1
(45) Date of Patent: Feb. 2, 2021

(54) DISPLAY DEVICE WITH DISTRIBUTED DRIVER CIRCUITS AND SHARED MULTI-WIRE COMMUNICATION INTERFACE FOR DIMMING DATA

(71) Applicant: Huayuan Semiconductor (Shenzhen) Limited Company, Shenzhen (CN)

(72) Inventors: Junjie Zheng, Cupertino, CA (US); Richard Landry Gray, Tapei (TW); Chih-Chang Wei, Taoyuan (TW); Li-Lun Chi, Taipei (TW)

(73) Assignee: HUAYUAN SEMICONDUCTOR (SHENZHEN) LIMITED COMPANY, Shenzhen (CN)

( * ) Notice: Subject to any disclaimer, the term of this patent is extended or adjusted under 35 U.S.C. 154(b) by 0 days.

(21) Appl. No.: 17/026,136

(22) Filed: Sep. 18, 2020

(51) Int. Cl.
*G09G 3/32* (2016.01)
*G09G 5/10* (2006.01)

(52) U.S. Cl.
CPC ..... *G09G 3/32* (2013.01); *G09G 5/10* (2013.01); *G09G 2310/08* (2013.01); *G09G 2320/0646* (2013.01)

(58) Field of Classification Search
CPC ..... G09G 5/10; G09G 3/32; G09G 2310/08; G09G 2320/0646
See application file for complete search history.

(56) References Cited

U.S. PATENT DOCUMENTS

| | | | | |
|---|---|---|---|---|
| 8,941,697 | B2 * | 1/2015 | Nathan | H05B 47/10 345/690 |
| 10,515,588 | B2 * | 12/2019 | Yuan | G09G 3/3266 |
| 2017/0229060 | A1 * | 8/2017 | Sakamaki | G09G 3/3648 |
| 2019/0096300 | A1 * | 3/2019 | Lin | G09G 3/006 |
| 2020/0082751 | A1 * | 3/2020 | Wu | G09G 3/006 |

* cited by examiner

*Primary Examiner* — Muhammad N Edun
(74) *Attorney, Agent, or Firm* — Fenwick & West LLP

(57) ABSTRACT

Embodiments relate to a display device that includes a control circuit, an array of light emitting diode (LED) zones, and an array of driver circuits that are distributed in the display area. The driver circuits are arranged in groups that are coupled to each other and to the control circuit in a serial communication chain via serial communication lines. The group of driver circuits are also coupled in parallel to a shared multi-wire command line that provides a high-speed interface for providing the driver control signals from the control circuit. The control circuit may furthermore issue readback commands to the driver circuits via the shared multi-wire command line or the serial communication chain. In response to the commands, the driver circuits provide readback data via a readback line through the serial communication chain or via parallel connections from the driver circuits.

25 Claims, 8 Drawing Sheets

DISPLAY DEVICE WITH DISTRIBUTED DRIVER CIRCUITS AND SHARED MULTI-WIRE COMMUNICATION INTERFACE FOR DIMMING DATA

BACKGROUND

This disclosure relates generally to light emitting diodes (LEDs) and LED driver circuitry for a display, and more specifically to a display architecture with distributed driver circuits.

LEDs are used in many electronic display devices, such as televisions, computer monitors, laptop computers, tablets, smartphones, projection systems, and head-mounted devices. Modern displays may include well over ten million individual LEDs that may be arranged in rows and columns in a display area. In order to drive each LED, current methods employ driver circuitry that requires significant amounts of external chip area that impacts the size of the display device.

SUMMARY

In a first aspect, a display device comprises an array of light emitting diode zones, a control circuit, a group of driver circuits distributed in the display area of the display device, a readback line, and a multi-wire shared command interface. The one or more light emitting diodes generate light in response to respective driver currents. The control circuit generates driver control signals and command signals. The group of driver circuits each drive a respective light emitting diode zone by controlling the respective driver currents in response to the driver control signals. The driver circuits furthermore generate readback data to the control circuit responsive to the command signals. The readback line communicates the readback data from the group of driver circuits to the control circuit. The multi-wire shared command interface is coupled between the control circuit and each of the driver circuits in the group of driver circuits and provides the driver control signals to the group of driver circuits.

In another aspect, a driver circuit for a display device includes control logic, and a set of pins including at least one LED driving output pin, a data input pin, a serial data output pin, a multi-pin command interface, a power pin, and a ground pin. The control logic operates in at least an addressing mode and an operational mode. In the operational mode, the control logic obtains a driver control signal and controls a driver current to an LED zone based on the driver control signal. The control logic further receives commands and outputs readback data responsive to the commands. In the addressing mode, the control logic obtains an incoming addressing signal, stores an address for the driver circuit based on the incoming addressing signal, and generates an outgoing addressing signal based on the incoming addressing signal. The LED driving output pin sinks the driver current during the operational mode. The data input pin receives the incoming addressing signal during the addressing mode and facilitates communication of the readback data via a serial communication chain during the operational mode. The serial data output pin outputs the outgoing addressing signal during the addressing mode and facilitates communication of the readback data via the serial communication chain during the operational mode. The multi-pin command interface receives the driver control signals from a control circuit via a multi-wire shared command interface. The power pin provides a supply voltage to the driver circuit and the ground pin to provide a path to ground.

In another aspect, a driver circuit for a display device includes control logic, at least one LED driving output pin, a data input pin, a serial data output pin, a parallel data output pin, a multi-pin command interface, a power pin, and a ground pin. The control logic operates in at least an addressing mode and an operational mode. In the operational mode, the control logic obtains a driver control signal and controls a driver current to an LED zone based on the driver control signal. The control logic further receives commands and outputs readback data responsive to the commands. In the addressing mode, the control logic obtains an incoming addressing signal, stores an address for the driver circuit based on the incoming addressing signal, and generates an outgoing addressing signal based on the incoming addressing signal. The LED driving output pin sinks the driver current during the operational mode. The data input pin receives the incoming addressing signal during the addressing mode. The serial data output pin outputs the outgoing addressing signal during the addressing mode. The parallel data output pin outputs the readback data to a readback line. The multi-pin command interface receives the driver control signals from a control circuit via a multi-wire shared command interface. The power pin provides a supply voltage. The ground pin provides a path to ground.

In another aspect, a driver circuit for a display device includes control logic, a dual-purpose output pin, a data input pin, a parallel data output pin, a multi-pin command interface, a power pin, and a ground pin. The control logic operates in at least an addressing mode and an operational mode. In the operational mode, the control logic obtains a driver control signal and controls a driver current to an LED zone based on the driver control signal. The control logic further receives commands and outputs readback data responsive to the commands. In the addressing mode, the control logic obtains an incoming addressing signal, stores an address for the driver circuit based on the incoming addressing signal, and generates an outgoing addressing signal based on the incoming addressing signal. The dual-purpose output pin sinks the driver current during the operational mode and outputs the outgoing addressing signal during the addressing mode. The data input pin receives the incoming addressing signal during the addressing mod. The parallel data output pin outputs the readback data to a readback line. The multi-pin command interface receives the driver control signals from a control circuit via a multi-wire shared command interface. The power pin provides a supply voltage. The ground pin provides a path to ground.

BRIEF DESCRIPTION OF THE DRAWINGS

The teachings of the embodiments of the present invention can be readily understood by considering the following detailed description in conjunction with the accompanying drawings.

Figure

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive aspect matter.

DETAILED DESCRIPTION OF EMBODIMENTS

Embodiments relate to a display device that includes a control circuit, an array of light emitting diode (LED) zones, and an array of driver circuits that are distributed in the display area. The driver circuits are arranged in groups that are coupled to each other and to the control circuit in a serial communication chain via serial communication lines. The group of driver circuits are also coupled in parallel to a shared multi-wire command line that provides a high-speed interface for providing the driver control signals from the control circuit. The control circuit may issue readback commands to the driver circuits via the shared multi-wire command line or the serial communication chain. In response to the commands, the driver circuits provide readback data via a readback line through the serial communication chain or via parallel connections from the driver circuits.

Figure 1:
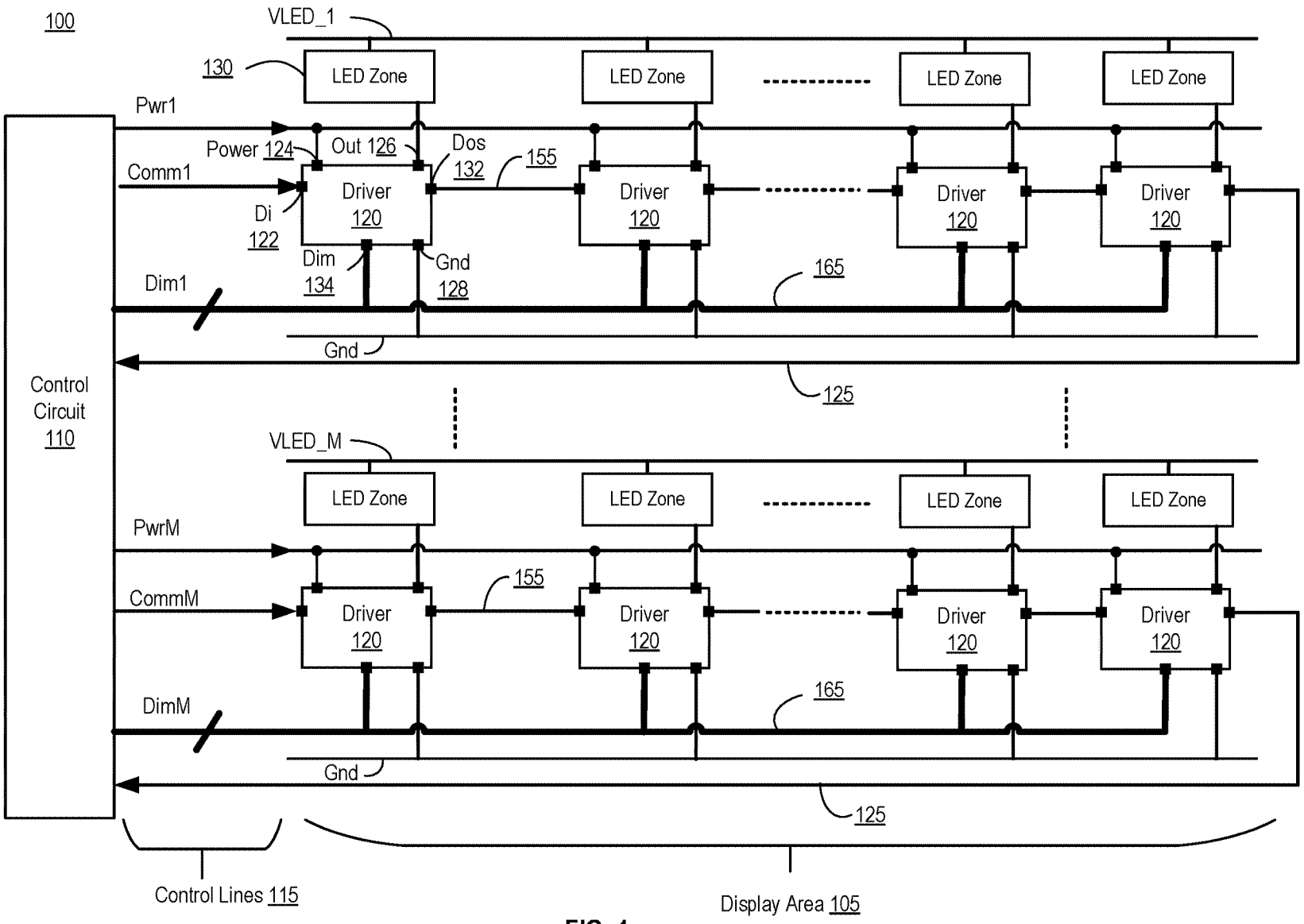
(FIG. 1 is a circuit diagram of a first embodiment of a display device including distributed driver circuits.

Figure (FIG. 1 is a circuit diagram of a display device 100 for displaying images or video. In various embodiments, the display device 100 may be implemented in any suitable form-factor, including a display screen for a computer display panel, a television, a mobile device, a billboard, etc. The display device 100 may include a display area 105, a control circuit 110, and a set of control lines 115. The display area 105 comprises an array of LED zones 130 and distributed driver circuits 120 that drive the LED zone 130. The display area 105 comprises an array of pixels for displaying images based on data received from the control circuit 110. The display area 105 may include LED zones 130, a set of distributed driver circuits 120, power supply lines including VLED lines (e.g., VLED_1, . . . VLED_M), driver supply lines, Pwr, and ground (GND) lines, and various signaling lines including serial communication lines 155 that serially couple the driver circuits 120 to each other and to the control circuit 110, a shared command interface 165, and an optional readback line 125.

Figure 4A:
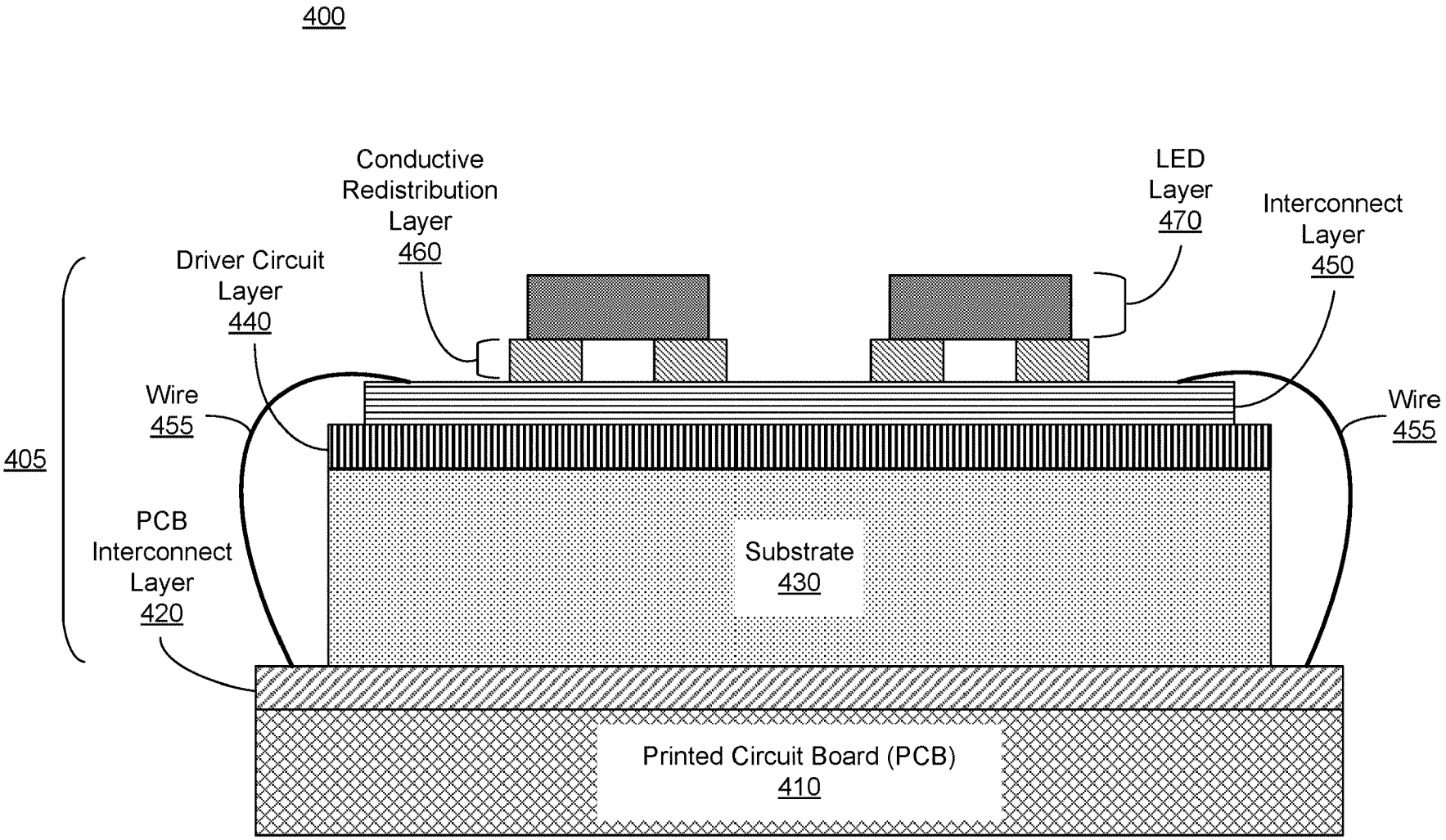
FIG. 4A is a cross sectional view of a first embodiment of an LED and driver circuit that may be utilized in a display device.
Figure 4B:
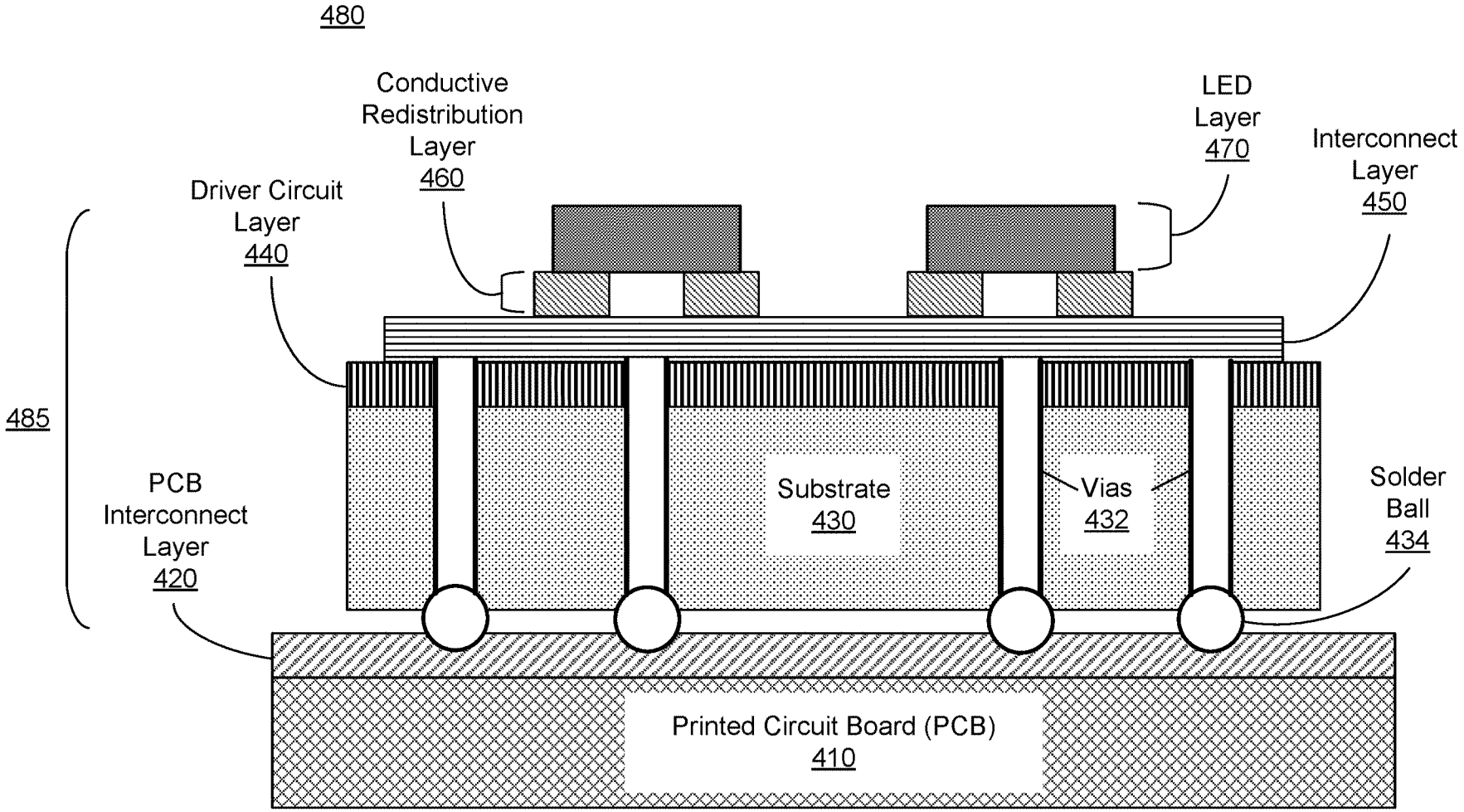
FIG. 4B is a cross sectional view of a second embodiment of an LED and driver circuit that may be utilized in a display device.
Figure 4C:
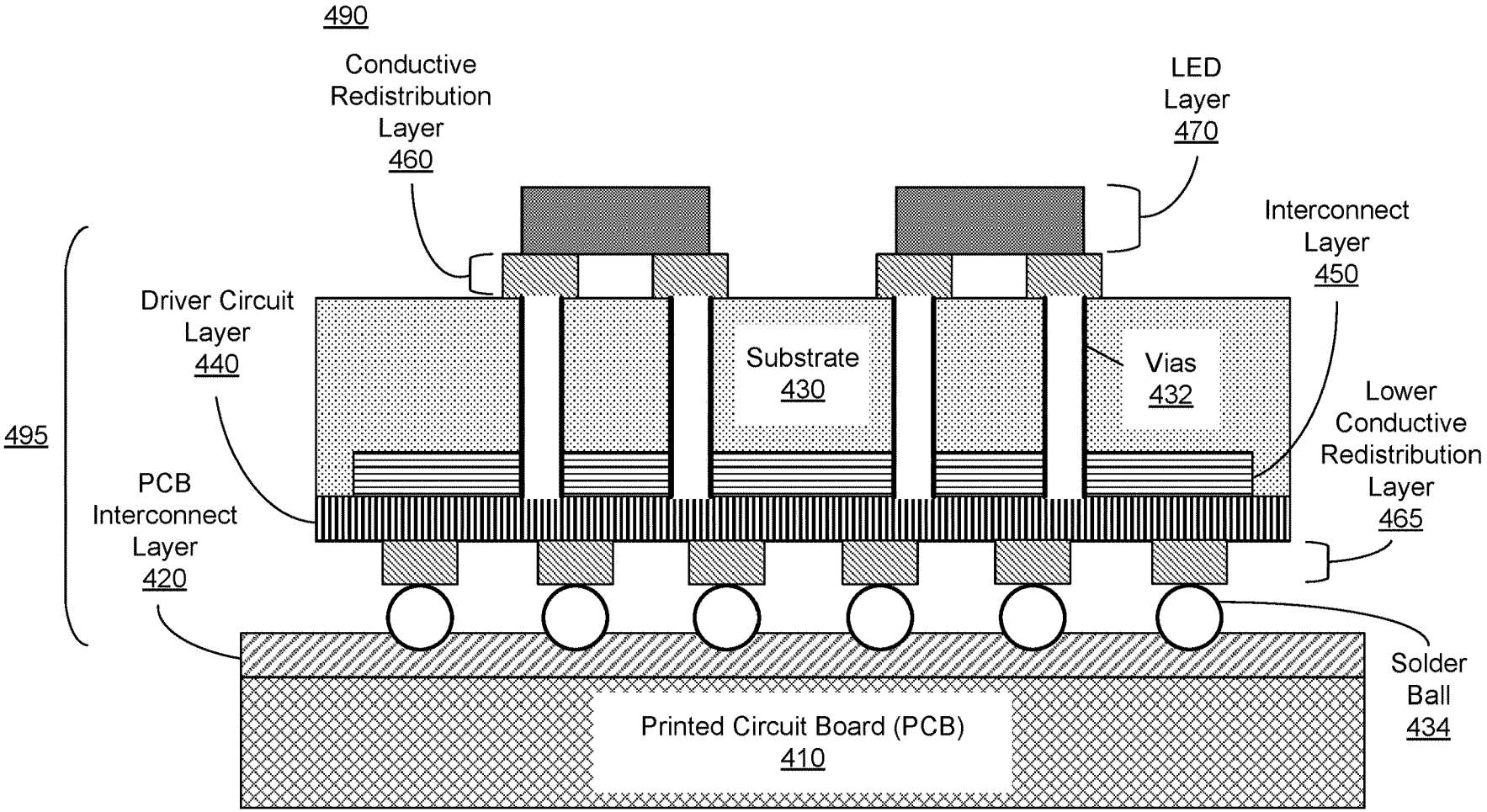
FIG. 4C is a cross sectional view of a third embodiment of an LED and driver circuit that may be utilized in a display device.
Figure 5:
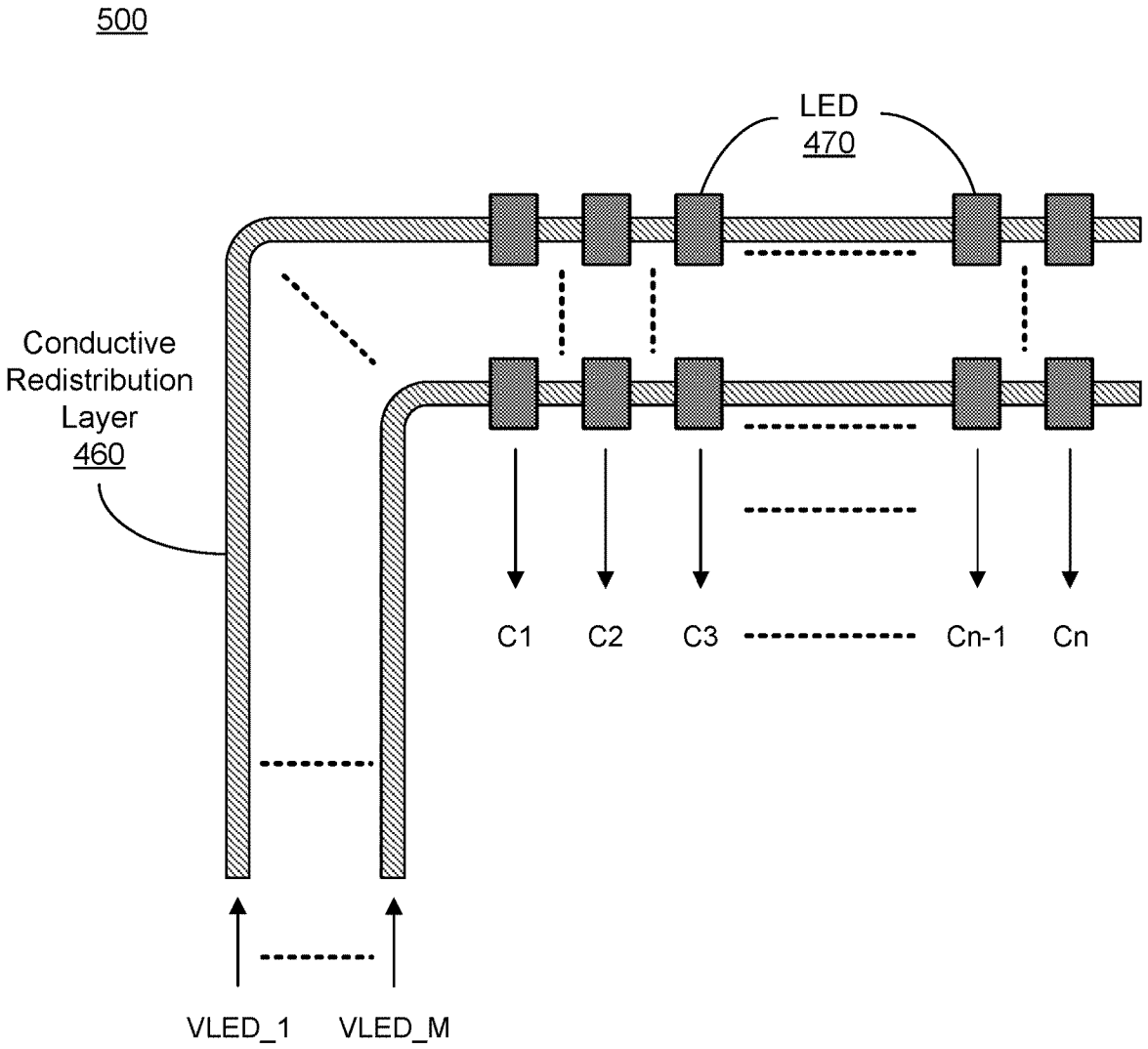
FIG. 5 is a top down view of a display device using an LED and driver circuit, according to one embodiment.
Figure 6:
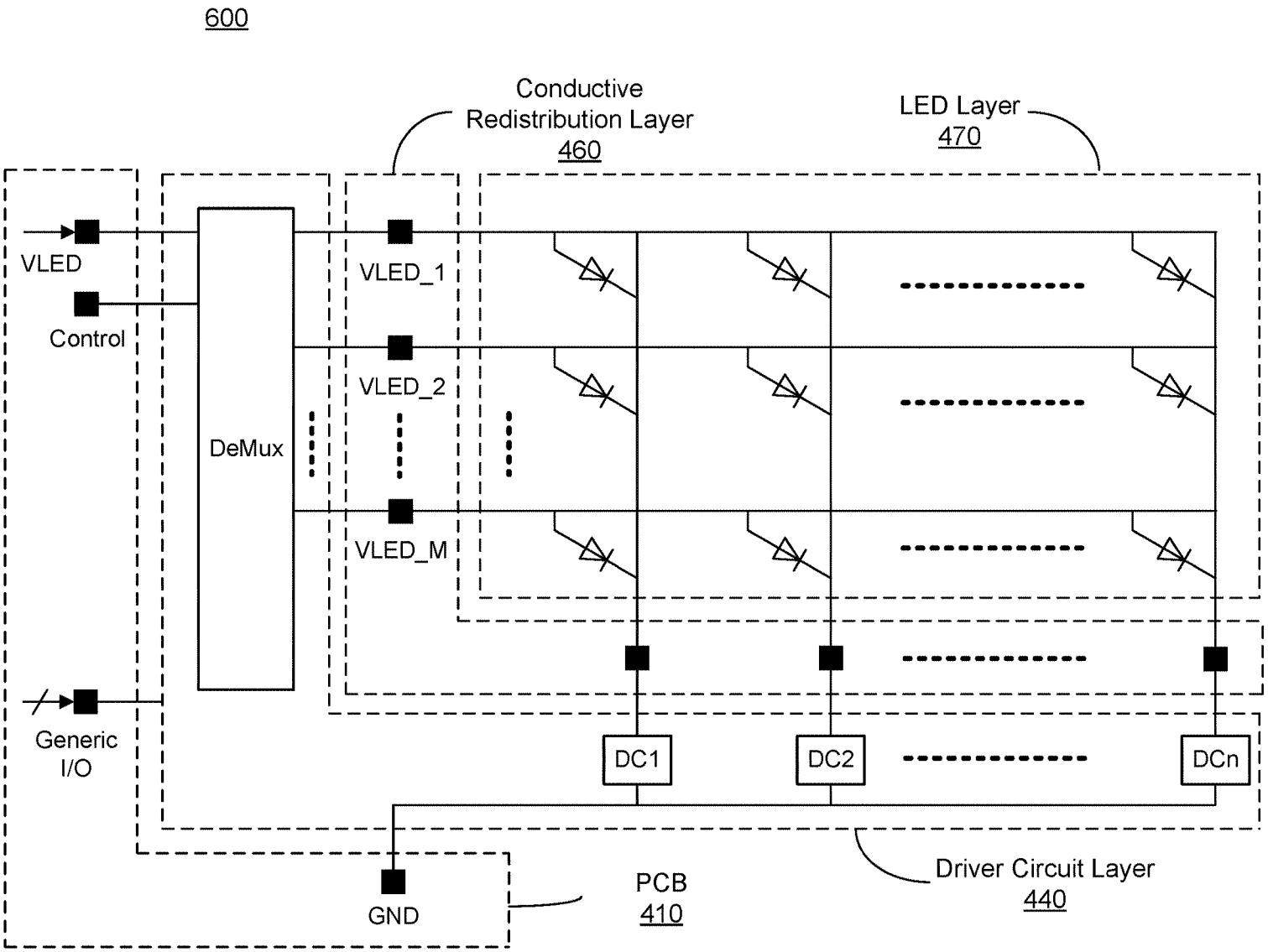
FIG. 6 illustrates a schematic view of several layers of an LED and driver circuit for a display device, according to one embodiment.

The driver circuit 120 and corresponding LED zone 130 may be embodied in an integrated package such that the LED zone 130 is stacked over the driver circuits 120 on a substrate as further described in FIGS. 4-6. Alternatively, the driver circuit 120 and corresponding LED zone 130 may be embodied in separate packages.

The display device 100 may comprise a liquid crystal display (LCD) device or an LED display device. In an LCD display device, LEDs provide white light backlighting that passes through liquid crystal color filters that control the color of individual pixels of the display. Each LED zone 130 may include LEDs corresponding to a one-dimensional or two-dimensional array of pixels. In an LED display device, LEDs are directly controlled to emit colored light corresponding to each pixel of the display device 100. Here, each LED zone 130 may comprise one or more LEDs corresponding to a single pixel or may comprise a one-dimensional array or two-dimensional array of LEDs corresponding to an array of pixels (e.g., one or more columns or rows). For example, in one embodiment, the LED zone 130 may comprise one or more groups of red, green, and blue LEDs that each correspond to a sub-pixel of a pixel. In another embodiment, the LED zone 130 may comprise one or more groups of red, green, and blue LED strings that correspond to a column or partial column of sub-pixels or a row or partial row of sub-pixels. For example, an LED zone 130 may comprise a set of red sub-pixels, a set of green sub-pixels, or a set of blue sub-pixels.

The LEDs of each LED zone 130 may be organic light emitting diodes (OLEDs), inorganic light emitting diodes (ILEDs), mini light emitting diodes (mini-LEDs) (e.g., having a size range between 100 to 300 micrometers), micro light emitting diodes (micro-LEDs) (e.g., having a size of less than 100 micrometers), white light emitting diodes (WLEDs), active-matrix OLEDs (AMOLEDs), transparent OLEDs (TOLEDs), or some other type of LEDs.

The driver circuits 120 are distributed in the display area 105 and drive corresponding LED zones 130 by controlling a drive current through the LED zones 130 based on driver control signals received from the control circuit 110. For example, the driver circuits 120 may adjust a current level and/or duty cycle of the drive current to achieve a desired brightness of the LEDs in the LED zone 130. In an embodiment, the driver circuits 120 may each control two or more color channels of an LED zone 130 (e.g., red, green, and blue color channels) via independently controllable drive currents for each channel.

In an embodiment, the driver circuits 120 may furthermore include integrated sensors. For example, the driver circuits 120 may include integrated temperature sensors, light sensors, voltage sensors, image sensors, or other sensing devices. In response to readback commands from the control circuit 110, the driver circuits 120 output requested sensor data to the control circuit 110 that may be utilized by the control circuit 110 to adjust operation of display device 100 (e.g., adjusting the driver control signals). In alternative embodiments, the display area 105 may include dedicated sensor devices (not shown) external to the driver circuits 120 that provide one or more sensing functions. The dedicated sensor device may similarly provide readback data to the control circuit 110 for adjusting operation of the display device 100.

The driver circuits 120 may be arranged in groups (e.g., rows) that share common power supply lines (including driver circuit supply lines Pwr and LED zone supply lines VLED) and control lines 115. For example, the driver circuits 120 in a group may be coupled in parallel to a shared command interface 165. Serial communication lines 155 also couple the driver circuits 120 of a group in series to each other and to the control circuit 110 to enable communications between the driver circuits 120 and the control circuit 110 via a serial communication chain. The serial communication lines 155 may be configured for unidirectional or bidirectional communication in different embodiments. In the case of unidirectional serial communication lines 155, a readback line 125 may couple the driver circuit 120 in each group to the control circuit 110. In the case of bidirectional serial communication lines 155, the readback line 125 may be optionally omitted.

The shared command interface 165 comprise a high-speed interface for communicating with the driver circuits 120. In an embodiment, the shared command interface comprises a two-wire interface including a single-ended data line providing a data signal and a single-ended clock line providing a clock signal. Data on the signal line may be synchronized with the clock signal. For example, data may be read on every rising edge, every falling edge, or both. In another embodiment, the shared command interface comprises a two-wire interface including differential data lines for transmitting a differential data signal. In this embodiment, the driver circuits 120 may include a clock recovery circuit to recover a clock providing timing of the differential data signal. In yet another embodiment, a "clockless" encoding method such as Bit Phase Mark encoding may be used to encode the differential data signal so that the data can be decoded without requiring a clock recovery circuit to recover a clock. In yet another embodiment, the shared command interface comprises a three-wire interface including differential data lines providing a differential data signal and a single-ended clock line providing a clock signal. In yet another embodiment, the shared command interface 165 may comprise a four-wire interface including differential data lines providing a differential data signal and differential clock lines providing a differential clock signal. In an embodiment, terminations are included on the shared command interface 165 at the end of each group of driver circuits 120 and compensating impedances are included along the signal path to minimize reflections. Furthermore, if the shared command interface 165 utilizes differential clock and/or data signal lines, the different lines may be flanked on both sides by an opposite polarity signal to reduce electromagnetic interference.

The driver circuits 120 include control logic that may operate in various modes including at least an addressing mode, a configuration mode, and an operational mode. During the addressing mode, the control circuit 110 initiates an addressing procedure to cause assignment of addresses to each of the driver circuits 120. During the configuration and operational modes, the control circuit 110 transmits commands and data that may be targeted to specific driver circuits 120 based on their addresses. In the configuration mode, the control circuit 110 configures driver circuits 120 with one or more operating parameters (e.g., overcurrent thresholds, overvoltage thresholds, clock division ratios, and/or slew rate control). During the operational mode, the control circuit 110 provides control data to the driver circuits 120 that causes the driver circuits to control the respective driver currents to the LED zones 130, thereby controlling brightness. The control circuit 110 may also issue commands to the driver circuits 120 during the operational mode to request readback data (e.g., sensor data), and the driver circuits 120 provide the requested readback data to the control circuit 110 in response to the commands.

The serial communication lines 155 may be utilized in the addressing mode to facilitate assignment of addresses. Here, an addressing signal is sent from the control circuit 110 via the serial communication lines 155 to the first driver circuit 120 in a group of driver circuits 120. The first driver circuit 120 stores an address based on the incoming addressing signal and generates an outgoing addressing signal for outputting to the next driver circuit 120 via the serial communication line 155. The second driver circuit 120 similarly receives the addressing signal from the first driver circuit 120, stores an address based on the incoming addressing signal, and outputs an outgoing addressing signal to the next driver circuit 120. This process continues through the chain of driver circuits 120. The last driver circuit 120 may optionally send its assigned address back to the control circuit 110 to enable the control circuit 110 to confirm that addresses have been properly assigned. The addressing process may be performed in parallel or sequentially for each group (e.g., each row) of driver circuits 120.

In an example addressing scheme, each driver circuit 120 may receive an address, store the address, increment the address by 1 or by another fixed amount, and send the incremented address as an outgoing addressing signal to the next driver circuit 120 in the group. Alternatively, each driver circuit 120 may receive the address of the prior driver circuit 120, increment the address, store the incremented address, and send the incremented address to the next driver circuit 120. In other embodiments, the driver circuit 120 may generate an address based on the incoming address signal according to a different function (e.g., decrementing).

After addressing, commands may be sent to the driver circuits 120 based on the addresses. The commands may include dimming commands to control dimming of the LED zones 130 or readback commands that request readback data from a driver circuit 120. For dimming commands, the driver circuits 120 receive the dimming data and adjust the driving currents to the corresponding LED zone 130 to achieve the desired brightness. The feedback commands may request information such as channel voltage information, temperature information, light sensing information, status information, fault information, or other data. In response to these commands, the driver circuits 120 may obtain the data from integrated sensors and send the readback data to the control circuit 110.

Commands may be sent to the driver circuits 120 via the shared command interface 165, via the serial communication lines 155 and serially connected driver circuits 120, or a combination of both. For example, in one embodiment, driver control signals for controlling dimming are sent via the shared command interface 165 while readback commands are sent via the serial communication lines 155. Alternatively, both readback commands and the driver control signals are sent via the shared command interface 165 and the serial communication lines 155 are used only for addressing and to transmit the readback data back to the control circuit 110. If commands are sent via the shared command interface 165, the targeted driver circuits 120 having the specified address processes the command while the other driver circuits 120 may ignore the command. If the commands are sent via the serial communication lines 155, the driver circuits 120 that are not targeted by the command may propagate the command to an adjacent driver circuit 120 via the serial communication lines 155 until it reaches the targeted driver circuit 120, which processes the command.

In response to a readback command, the targeted driver circuit 120 transmits the requested readback data to the control circuit 110 via the serial communication lines 155. For example, upon receiving a command, a targeted driver circuit 120 outputs the readback data to an adjacent driver circuit 120 via the serial communication lines 155. Each subsequent driver circuit 120 receives the readback data and propagates it to the next driver circuit 120 in the serial chain until it reaches the control circuit 110. Readback data can propagate through the chain in either direction. For example, the group of driver circuits 110 may propagate the readback data in a forward direction in which each driver circuit 120 outputs the readback data to an adjacent driver circuit 120 at increasing distance from the control circuit 110 until it reaches the last driver circuit 120, which then returns the readback data via the readback line 125. Alternatively, the group of driver circuits 120 may propagate the readback data in a backward direction in which each driver circuit 120 outputs the readback data to an adjacent driver circuit 120 at decreasing distance from the control circuit 110 until it reaches the control circuit 110. In an embodiment, responses to readback commands may include the address of the targeted driver circuit 120 to enable the control circuit 110 to confirm which driver circuit 120 provided the response.

In other embodiments, the control circuit 110 may issue a group command that is targeted to the group of driver circuits 120 instead of targeting an individual driver circuit 120. In this case, data may be processed by each driver circuit 120 as the command and data propagates through the chain to provide a single result to the control circuit 110. For example, in one embodiment, the control circuit 110 may issue a channel sensing command through the serial communication line 155. The first driver circuit 120 receives the channel voltage sensing command and outputs the command together with its sensed channel voltage to the next driver circuit 120. The next driver circuit 120 receives the command and the incoming channel voltage value from the previous driver circuit 120, senses its own channel voltage, and applies a function to the incoming channel voltage value and the sensed channel voltage to generate an outgoing channel voltage value that it outputs via the serial communication line 155. Here, the function may comprise a minimum function such that the driver circuit 120 compares the received channel voltage with its sensed channel voltage, and outputs via the serial communication line 155, the lower of the received channel voltage from the prior driver circuit 120 and the sensed channel voltage from the current driver circuit 120. Alternatively, the function may comprise, for example, a maximum function, an average function, or other function. This process repeats throughout the chain of driver circuits 120 so that each driver circuit 120 outputs a resulting value (e.g., a min, max, or average value) based on the sensed channel voltages detected among the current driver circuits 120 and all prior driver circuits 120. The resulting readback data received by the control circuit 110 represents a function (e.g., a min, max, or average) of each of the detected channel voltages in the group of driver circuits 120. The control circuit 110 can then set a shared supply voltage VLED for the LED zones 130 in each group or another control parameter according to the readback data. For example, by applying a minimum function to obtain the lowest channel voltage in the group, the control circuit 110 can set the supply voltage VLED for the LED zones 130 to a level sufficient to drive the LED zone 130 with the lowest sensed channel voltage to a predetermined level.

In another example, a group command may be utilized for temperature sensing. Here, the command and data are propagated through the serial communication chain in each group of driver circuit 120 as described above. At each step, a driver circuit 120 receives a temperature from an adjacent driver circuit 120, applies a function to the received temperature and its own sensed temperature to generate an outgoing temperature value, and outputs the outgoing temperature to the next driver circuit 120. Thus, the control circuit 110 can obtain a function of the sensed temperatures associated with each of the driver circuits 120 in the group. Here, the function may comprise, for example, summing or averaging, or detecting a minimum or maximum value. The control circuit 110 can then adjust the operation of the driver circuits 110 to account for temperature-dependent variations in the outputs of the LED zones 130.

In another example, a group command may be utilized for fault detection. Here, each driver circuit 120 may propagate a fault status request command through the chain and set a fault status flag if a fault is detected. The fault status flag may then be propagated to the control circuit 110 to enable the control circuit 110 to detect the faulty driver circuit 120 and adjust operation of the driver circuits 120 accordingly. In an embodiment, an address of the faulty driver circuit 120 may be sent together with the fault status flag to enable the control circuit 110 to detect the faulty driver circuit 120.

The described serial communication protocol can be utilized to calibrate a display device 100. For example, the control circuit 110 can change both the LED current and the on/off duty cycle of the driver circuits 120 in order to change the effective brightness of each LED zone 130 based on received feedback from the driver circuits 120. More specifically, the control circuit 110 may calibrate the driver circuits 120 so that LED zones 130 each output the same brightness in response to the same brightness control signal, despite process variations in the LEDs or associated circuitry that may otherwise cause variations. The calibration process may be performed by measuring light output, channel voltages, temperature, or other data that may affect performances of the LEDs using sensors in the display area 105. Alternatively, the measurements may be made by equipment outside of the display area 105, such as a separate high accuracy light meter used specifically for a calibration sequence. The calibration process may be repeated over time (e.g., as the display device 100 heats up during operation).

In other embodiments, a group of driver circuit 120 do not necessarily correspond to a row of the display area 105. In alternative embodiments, a group of serially connected driver circuit 120 coupled via serial communication lines 155 may instead correspond to a partial row of the display area 105 or a full or partial column of the display area 105. In another embodiment, a group of driver circuits 120 may correspond to a block of adjacent or non-adjacent driver circuits 120 that may span multiple rows and columns.

In different configurations, each one or more dedicated sensor circuits (not shown) may be coupled in a group of driver circuits 120. Here, the sensor circuits may have similar pin configurations and connectivity as the driver circuits 120 except they are not coupled to drive an LED zone 130. The sensor circuits may similarly facilitate addressing and readback through the serial communication chain and may similarly respond to readback commands with sensed readback data. In an example embodiment, the last element in each row may correspond to a sensor circuit. Alternatively, various sensor circuits may be interleaved with the driver circuits in a group of driver circuits 120.

The driver circuit 120 may include a power pin 124, a ground pin (Gnd) 128, one or more LED driving output pins (Out) 126, a data input pin (Di) 122, a serial data output pin 132, and a set of shared command interface pins 134.

The ground pin 128 is configured to provide a path to a ground line for the driver circuit 120, which may be common to the corresponding LED zone 130. The power pin 124 provides a connection to the driver circuit power supply line Pwr.

The data input pin 122 and the serial data output pin 132 are coupled to the serial communication lines 155 to facilitate serial communication to and from the driver circuits 120. The serial communication lines 155 may be used, for example, to assign addresses to the driver circuits 120, to send readback commands to the driver circuits 120, or to provide readback data to the control circuit 110 in response to commands as described above. As described above, in some embodiments, the data input pin 122 and serial data output pin 132 may facilitate bidirectional communication, in which case data may propagate in the reverse direction from the input pin 122 of one driver circuit 120 to a serial data output pin 132 of an adjacent driver circuit 120.

The one or more LED driving output pins 126 is coupled to the LED zone 130 to control the driver current through the LED zones 130. In an embodiment, the one or more LED driving output pins 126 may comprise a set of multiple pins to control different respective channels of the LED zone 130. For example, in an LED display device, the LED driving output 126 may include 3 pins to control red, green, and blue channels of the LED zones 130. Alternatively, in an LCD display device, the LED driving output 126 may comprise a single pin for controlling a white backlighting channel.

The set of shared command interface pins 134 facilitate communication over the shared command line interface 165. As described above, the set of shared command interface pins 134 may comprise a two-pin interface corresponding to a single-ended data line and a single-ended clock line, a two-pin interface corresponding to a pair of differential data lines, a three-pin interface corresponding to a pair of differential data lines and a single-ended clock line, or a four-pin interface corresponding to a pair of differential data lines and a pair of differential clock lines.

In another embodiment, the shared command interface 165 may comprise a bi-directional interface. In this embodiment, some or all of the readback data may be sent to the control circuit 110 via the shared command interface 165 instead of through the serial communication chain.

Figure 2:
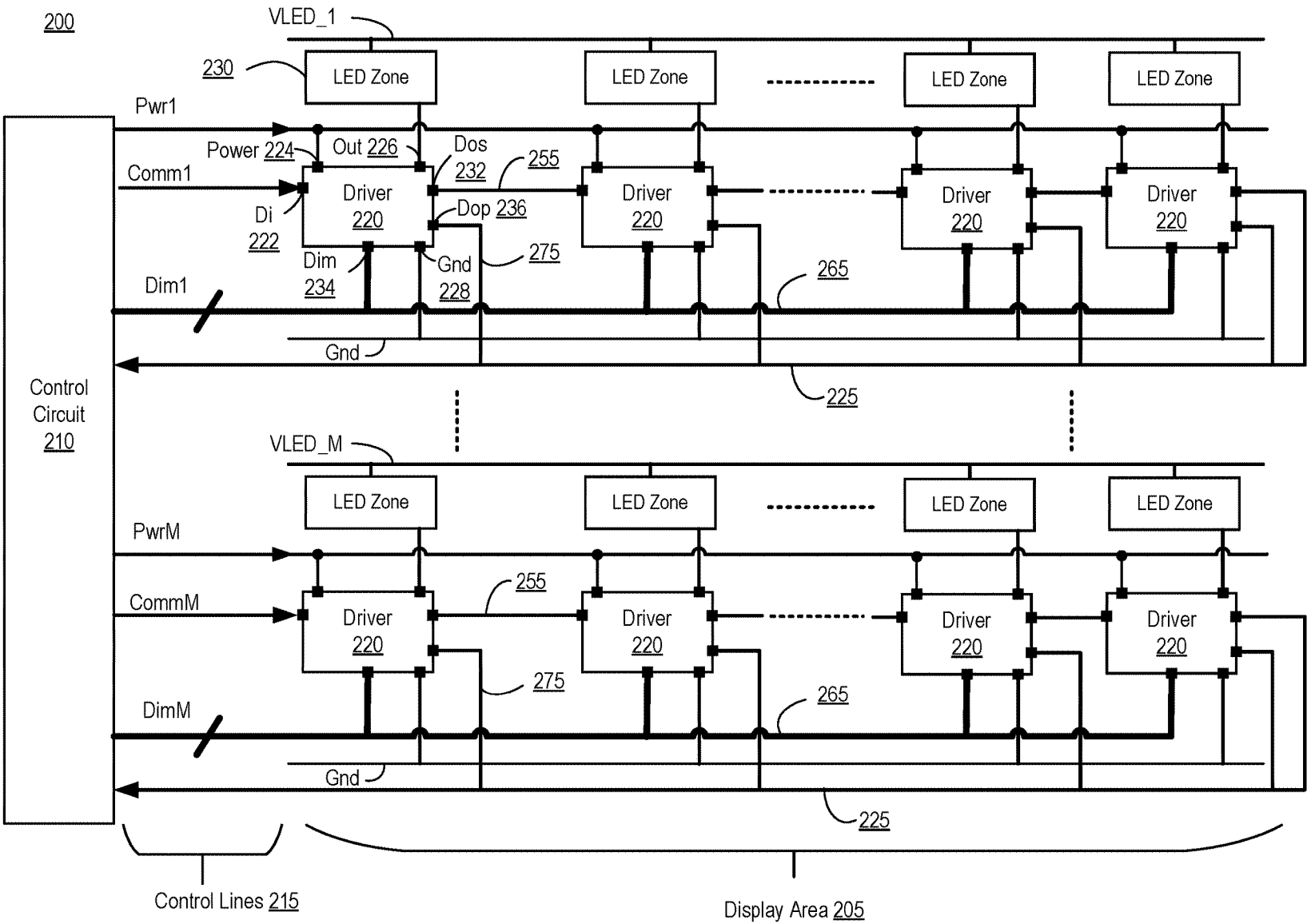
FIG. 2 is a circuit diagram of a second embodiment of a display device including distributed driver circuits.

FIG. 2 illustrates an alternative embodiment of a display device 200 including a control circuit 210, a set of control lines 215, and a display area 205. The display area 205 includes an array of driver circuits 220 for driving respective LED zones 230. The driver circuits 220 each include a power pin 224, a ground pin 228, a data input pin 222, a serial data output pin 232, a parallel data output pin 236, one or more LED driving output pins 226, and a multi-pin shared command interface 234. The LED zones 230 in a group share a common LED supply line VLED and the driver circuits 220 in a group share a common power line Pwr and ground line Gnd. Each driver circuit drives one or more channels of a corresponding LED zone 230 via the one or more LED driving output pins 236. Serial communication lines 255 couple the control circuit 210 to the data input pin 222 of the first driver circuit 220 in a group of driver circuits 220 and couple serially between the serial data output pin 232 and the data input pin 222 of adjacent driver circuits 220. The driver circuits 220 are furthermore coupled in parallel to a readback line 225 via the parallel data output pins 236. The readback line 225 also optionally couples the serial data output pin 232 of the last driver circuit 220 in the group to the control circuit 210. The shared command interface 265 is furthermore coupled in parallel to each of the driver circuits 220 in the group via the shared command interface pins 234.

The display device 200 is similar to the display device 100 of FIG. 1, except that the driver circuits 220 include an additional pin (the parallel data output pin 236) that couples each driver circuit 220 in parallel to the readback line 225. This embodiment also operates similarly to the display device 100 of FIG. 1 described above, except that readback data is outputted via the parallel data output pins 236 instead of the serial data output pins 232. The driver circuits 220 may furthermore operate to place their parallel data output pins 236 in a high impedance state when not outputting readback data to avoid interfering with a targeted driver circuit 220 that is outputting readback data. This embodiment may enable faster readback because readback data is passed directly from a driver circuit 220 to the control circuit 210 without propagating through the serial communication chain.

As with the embodiment of FIG. 1, the display area 205 may optionally include one or more dedicated sensor circuits (not shown) having similar connectivity to the driver circuits 220 except that they are not coupled to drive an LED zone 230. The sensor circuits may output readback data on the readback line 225 via a parallel connection in a similar fashion as the driver circuits 220 described above.

In an embodiment, the shared command interface 265 may comprise a bi-directional interface. In this embodiment, some or all of the readback data may be sent to the control circuit 210 via the shared command interface 265 instead of through the readback line 225. In some embodiments, the readback line 225 may be omitted.

Figure 3:
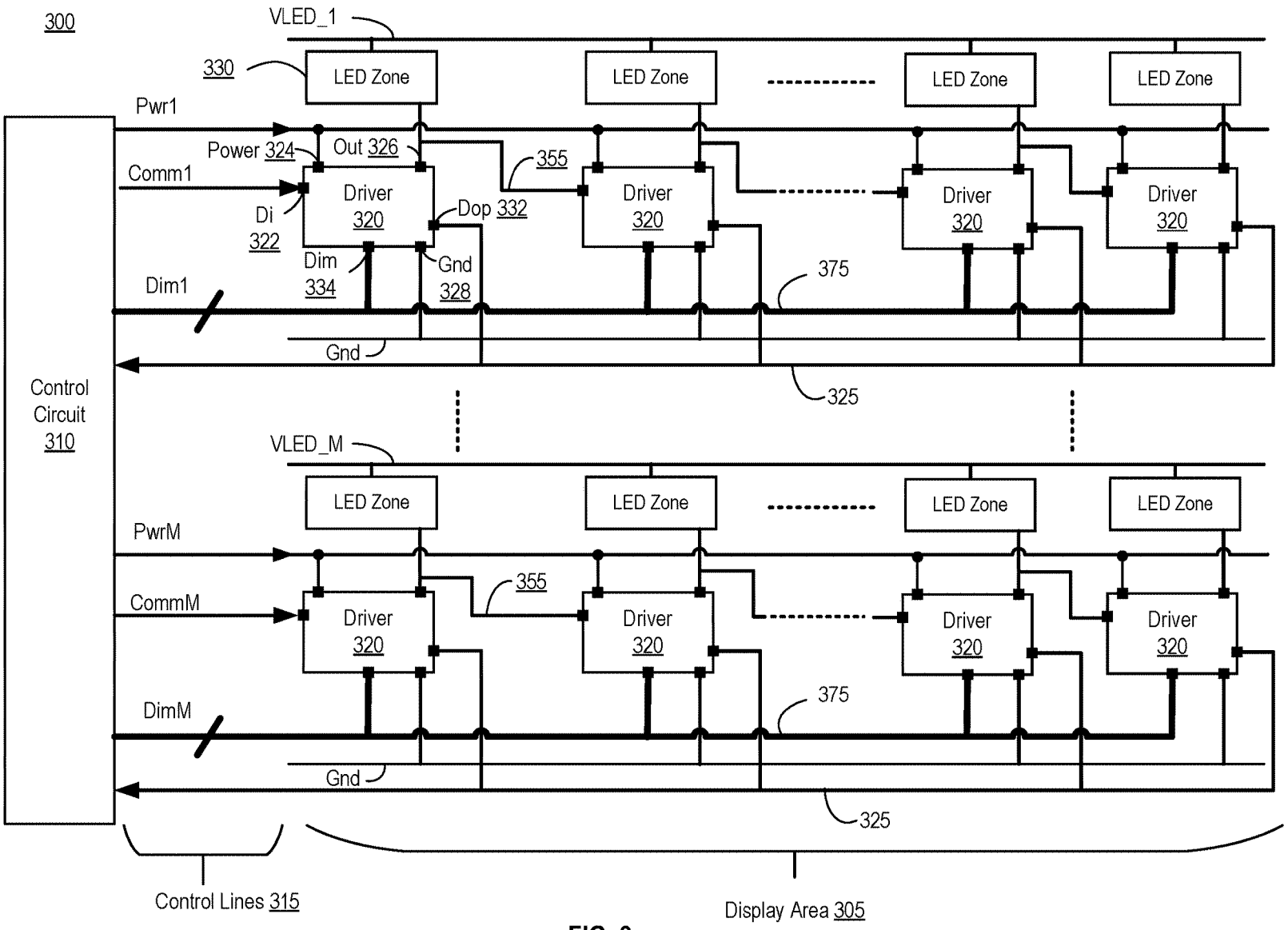
FIG. 3 is a circuit diagram of a third embodiment of a display device including distributed driver circuits.

FIG. 3 illustrates another embodiment of a display device 300 including a control circuit 310, a set of control lines 315, and a display area 305. The display area 305 includes an array of driver circuits 320 for driving respective LED zones 330. The driver circuits 320 each include a power pin 324, a ground pin 328, a data input pin 322, a parallel data output pin 336, one or more LED driving output pins 326, and a multi-pin shared command interface 334. The LED zones 330 in a group share a common LED supply line VLED and the driver circuits 320 in a group share a common power line Pwr and ground line Gnd. Each driver circuit 320 drives one or more channels of a corresponding LED zone 330 via the one or more LED driving output pins 336. Serial communication lines 355 couple the control circuit 310 to the data input pin 322 of the first driver circuit 320 in a group of driver circuits 320 and couple serially between the one of the LED driving output pins 326 and the data input pin 322 of adjacent driver circuits 320. The driver circuits 220 are furthermore coupled in parallel to a readback line 325 via the parallel data output pins 336. The shared command interface 265 is furthermore coupled in parallel to each of the driver circuits 320 in the group via the shared command interface pins 334.

The display device 300 is similar to the display device 300 of FIG. 2, except that the driver circuits 320 lack the serial data output pin 332. Instead, one of the LED driving output pins 326 serves a dual-purpose dependent on the mode of operation. In the addressing mode, one of the LED driving output pins 326 facilitates communications on the serial communication lines 355 as described above. During addressing, the driver circuit 320 may set the LED driving current on at least this channel to zero (and may also set the VLED voltage to zero), so that driver current does not interfere with the serial communication used for addressing. In the operational mode, the dual-purpose output pin 326 is coupled to sink current from a channel of the corresponding LED zone 330 to control the driver current as described in the preceding embodiments. Here, the output pin 326 is decoupled from the serial communication line 355 while driving the LED zone 330 to avoid interfering with the LED driver current.

As with the embodiments of FIGS. 2-3, the display area 305 may optionally include one or more dedicated sensor circuits (not shown) having similar connectivity to the driver circuits 320 except that they are not coupled to drive an LED zone 330. The sensor circuits may output readback data on the readback line 325 via a parallel connection in a similar fashion as the driver circuits 320 described above.

In an embodiment, the shared command interface 365 may comprise a bi-directional interface. In this embodiment, some or all of the readback data may be sent to the control circuit 210 via the shared command interface 365 instead of through the readback line 325. In some embodiments, the readback line 325 may be omitted.

FIG. 4A is a cross sectional view of a first embodiment of a zone IC 400 that includes an integrated LED and driver circuit 405 in a single package. In the example shown in FIG. 4A, the circuit 400 includes a printed circuit board (PCB) 410, a PCB interconnect layer 420, and the integrated LED and driver circuit 405 which comprises a substrate 430, a driver circuit layer 440, an interconnect layer 450, a conductive redistribution layer 460, and an LED layer 470. Bonded wires 455 may be included for connections between the PCB interconnect layer 420 and the integrated LED and driver circuit 405. The PCB 410 comprises a support board for mounting the integrated LED and driver circuit 405, the control circuit and various other supporting electronics. The PCB 410 may include internal electrical traces and/or vias that provide electrical connections between the electronics. A PCB interconnect layer 420 may be formed on a surface of the PCB 410. The PCB interconnect layer 420 includes pads for mounting the various electronics and traces for connecting between them.

The integrated LED and driver circuit 405 includes a substrate 430 that is mountable on a surface of the PCB interconnect layer 420. The substrate 430 may be, e.g., a silicon (Si) substrate. In other embodiments, the substrate 430 may include various materials, such as gallium arsenide (GaAs), indium phosphide (InP), gallium nitride (GaN), AlN, sapphire, silicon carbide (SiC), or the like.

A driver circuit layer 440 may be fabricated on a surface of the substrate 430 using silicon transistor processes (e.g., BCD processing) or other transistor processes. The driver circuit layer 440 may include one or more driver circuits (e.g., a single driver circuit or a group of driver circuits arranged in an array). An interconnect layer 450 may be formed on a surface of the driver circuit layer 440. The interconnect layer 450 may include one or more metal or metal alloy materials, such as Al, Ag, Au, Pt, Ti, Cu, or any combination thereof. The interconnect layer 450 may include electrical traces to electrically connect the driver circuits in the driver circuit layer 440 to wire bonds 455, which are in turn connected to the control circuit on the PCB 410. In an embodiment, each wire bond 455 provides an electrical connection to the control circuit in accordance with the connections described in any of the preceding embodiments.

In an embodiment, the interconnect layer 450 is not necessarily distinct from the driver circuit layer 440 and these layers 440, 450 may be formed in a single process in which the interconnect layer 450 represents a top surface of the driver layer 440.

The conductive redistribution layer 460 may be formed on a surface of the interconnect layer 450. The conductive redistribution layer 460 may include a metallic grid made of a conductive material, such as Cu, Ag, Au, Al, or the like. An LED layer 470 includes LEDs that are on a surface of the conductive redistribution layer 460. The LED layer 470 may include arrays of LEDs arranged into the LED zones as described above. The conductive redistribution layer 460 provides an electrical connection between the LEDs in the LED layer 470 and the one or more driver circuits in the driver circuit layer 440 for supplying the driver current and provides a mechanical connection securing the LEDs over the substrate 430 such that the LED layer 470 and the conductive redistribution layer 460 are vertically stacked over the driver circuit layer 440.

Thus, in the illustrated circuit 400, the one or more driver circuits and the LED zones including the LEDs are integrated in a single package including a substrate 430 with the LEDs in an LED layer 470 stacked over the driver circuits in the driver circuit layer 440. By stacking the LED layer 470 over the driver circuit layer 440 in this manner, the driver circuits can be distributed in the display area of a display device.

FIG. 4B is a cross sectional view of a second embodiment of a display device 480 including an integrated LED and driver circuit 485, according to one embodiment. The device 480 is substantially similar to the device 400 described in FIG. 4A but utilizes vias 432 and corresponding connected solder balls 434 to make electrical connections between the driver circuit layer 440 and the PCB 410 instead of the wires 455. Here, the vias 432 are plated vertical electrical connections that pass completely through the substrate layer 430. In one embodiment, the substrate layer 430 is a Si substrate and the through-chip vias 432 are Through Silicon Vias (TSVs). The through-chip vias 432 are etched into and through the substrate layer 430 during fabrication and may be filled with a metal, such as tungsten (W), copper (C), or other conductive material. The solder balls 434 comprise a conductive material that provide an electrical and mechanical connection to the plating of the vias 432 and electrical traces on the PCB interconnect layer 420. In one embodiment, each via 432 provides an electrical connection for providing signals such as the driver control signal from the control circuit on the PCB 410 to a group of driver circuits on the driver circuit layer 440. The vias 432 may also provide connections for the incoming and outgoing addressing signals, the supply voltage (e.g., VLED) to the LEDs in a LED zone on the LED layer 470, and a path to a circuit ground (GND).

FIG. 4C is a cross sectional view of a third embodiment of a display device 490 including an integrated LED and driver circuit 495. The device 490 is substantially similar to the device 480 described in FIG. 4B but includes the driver circuit layer 440 and interconnect layer 450 on the opposite side of the substrate 430 from the conductive redistribution layer 460 and the LED layer 470. In this embodiment, the interconnect layer 450 and the driver circuit layer 440 are electrically connected to the PCB 410 via a lower conductive redistribution layer 465 and solder balls 434. The lower conductive redistribution layer 465 and solder balls 434 provide mechanical and electrical connections (e.g., for the driver control signals) between the driver circuit layer 440 and the PCB interconnect layer 420. The driver circuit layer 440 and interconnect layer 450 are electrically connected to the conductive redistribution layer 460 and the LEDs of the LED layer 470 via one or more plated vias 432 through the substrate 430. The one or more vias 432 seen in FIG. 4C may be utilized to provide the driver currents from the driver circuits in the driver circuit layer 440 to the LEDs in the LED layer 470 and other signals as described above In alternative embodiments, the integrated driver and LED circuits 405, 485, 495 may be mounted to a different base such as a glass base instead of the PCB 410.

FIG. 5 is a top down view of a display device using an integrated LED and driver circuit 500, according to one embodiment. The circuit 500 can correspond to a top view of any of the integrated LED and driver circuits 405, 485, 495 depicted in FIGS. 4A-4C. A plurality of LEDs of an LED lay 470 is arranged in rows and columns (e.g., C1, C2, C3, . . . Cn−1, Cn). For passive matrix architectures, each row of LEDs of the LED layer 470 is connected by a conductive redistribution layer 460 to a demultiplexer which outputs a plurality of VLED signals (i.e., VLED_1 . . . VLED_M). The VLED signals provide power (i.e., a supply voltage) to a corresponding row of LEDs of the LED layer 470 via the conductive redistribution layer 460.

FIG. 6 illustrates a schematic view 600 of several layers of a display device with an integrated LED and driver circuit, according to one embodiment. The schematic view includes the PCB 410, the driver circuit layer 440, the conductive redistribution layer 460, and the LED layer 470 as described in FIGS. 4A-4C. The schematic of FIG. 6 shows circuit connections for the circuits 405, 485, 495 of FIGS. 4A-4C but does not reflect the physical layout. As described above, in the physical layout, the LED layer 470 is positioned on top of (i.e., vertically stacked over) the conductive redistribution layer 460. The conductive redistribution layer 460 is positioned on top of the driver circuit layer 440 and the driver circuit layer 440 is positioned on top of the PCB 410.

The PCB 410 includes a connection to a power source supplying power (e.g., VLED) to the LEDs, a control circuit for generating a control signal, generic I/O connections, and a ground (GND) connection. The driver circuit layer 440 includes a plurality of driver circuits (e.g., DC1, DC2, . . . DCn) and a demultiplexer DeMux. The conductive redistribution layer 460 provides electrical connections between the driver circuits and the demultiplexer DeMux in the driver circuit layer 440 to the plurality of LEDs in the LED layer 470. The LED layer 470 includes a plurality of LEDs arranged in rows and columns. In this example implementation, each column of LEDs is electrically connected via the conductive redistribution layer 460 to one driver circuit in the driver circuit layer 440. The electrical connection established between each driver circuit and its respective column of LEDs controls the supply of driver current from the driver circuit to the column. In this embodiment each diode shown in the LED layer corresponds to an LED zone. Each row of LEDs is electrically connected via the conductive redistribution layer 460 to one output (e.g., VLED_1, VLED_2, . . . VLED_M) of the demultiplexer DeMux in the driver circuit layer 440. The demultiplexer DeMux in the driver circuit layer 440 is connected to a power supply (VLED) and a control signal from the PCB 410. The control signal instructs the demultiplexer DeMux which row or rows of LEDs are to be enabled and supplied with power using the VLED lines. Thus, a particular LED in the LED layer 470 is activated when power (VLED) is supplied on its associated row and the driver current is supplied to its associated column.

Upon reading this disclosure, those of skill in the art will appreciate still additional alternative embodiments through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

The invention claimed is:

1. A display device comprising:

an array of light emitting diode zones each comprising one or more light emitting diodes that generate light in response to respective driver currents;

a control circuit to generate driver control signals and command signals;

a group of driver circuits distributed in the display area of the display device, the group of driver circuits to each drive a respective light emitting diode zone by controlling the respective driver currents in response to the driver control signals, and the driver circuits to generate readback data to the control circuit responsive to the command signals;

a readback line to communicate the readback data from the group of driver circuits to the control circuit; and a multi-wire shared command interface coupled to between the control circuit and each of the driver circuits in the group of driver circuits to provide the driver control signals to the group of driver circuits.

2. The display device of claim 1, further comprising:

a set of serial communication lines coupled between adjacent driver circuits and to the control circuit in a serial communication chain, wherein the control circuit facilitates assignment of addresses to the driver circuits during an addressing mode based on addressing signals transmitted through the serial communication chain.

3. The display device of claim 2, wherein the group of driver circuits further communicate the readback data from a target driver circuits to the control circuit through the serial communication chain and the readback line.

4. The display device of claim 2, wherein the readback line comprises a set of parallel connections to each of the driver circuits, wherein a target driver circuit communicates the readback data to the control circuit via a direct connection to the readback line.

5. The display device of claim 2, wherein the driver circuits each comprise respective dual-purpose output pins to control the driver currents during an operational mode and to communicate via the serial communication lines during the addressing mode.

6. The display device of claim 1, wherein the multi-wire shared command interface comprises:

a single-ended data signal line for communicating the driver control signals; and a single-ended clock signal line for communicating a clock signal, wherein the driver circuits read the single-ended data signal line synchronously with the clock signal.

7. The display device of claim 1, wherein the multi-wire shared command interface comprises:

differential data signal lines for communicating the driver control signals as differential signals, wherein the driver circuits include a clock recovery circuit to recover a clock signal associated with the differential signals, and wherein the driver circuits read the differential data signal lines synchronously with the recovered clock signal.

8. The display device of claim 1, wherein the multi-wire shared command interface comprises:

differential data signal lines for communicating the driver control signal as a differential signal that encodes data in a clockless encoding format.

9. The display device of claim 1, wherein the multi-wire shared command interface comprises:

differential data signal lines for communicating the driver control signals as differential signals; and a single-ended clock signal line for communicating a clock signal, wherein the driver circuits read the differential data signal lines synchronously with the clock signal.

10. The display device of claim 1, wherein the multi-wire shared command interface comprises:

differential data signal lines for communicating the driver control signals as differential signals; and differential clock signal lines for communicating a differential clock signal, wherein the driver circuits read the differential data signal lines synchronously with the differential clock signal.

11. The display device of claim 1, wherein the readback data comprises at least one of: sensed temperature data, sensed channel voltage data, and fault detection data.

12. The display device of claim 1, wherein the control circuit is configured to adjust the driver control signals or a power supply to the LED zones in response to the readback data.

13. The display device of claim 1, wherein each of the LED zones and corresponding driver circuits are stacked over a substrate in an integrated package.

14. A driver circuit for a display device comprising:

control logic to operate in at least an addressing mode and an operational mode, wherein in the operational mode, the control logic obtains a driver control signal and controls a driver current to an LED zone based on the driver control signal, and the control logic further receives commands and outputs readback data responsive to the commands, and wherein in the addressing mode, the control logic obtains an incoming addressing signal, stores an address for the driver circuit based on the incoming addressing signal, and generates an outgoing addressing signal based on the incoming addressing signal;

an LED driving output pin to sink the driver current during the operational mode;

a data input pin to receive the incoming addressing signal during the addressing mode and to facilitate communication of the readback data via a serial communication chain during the operational mode;

a serial data output pin to output the outgoing addressing signal during the addressing mode and to facilitate communication of the readback data via the serial communication chain during the operational mode;

a multi-pin command interface to receive the driver control signals from a control circuit via a multi-wire shared command interface;

a power pin to provide a supply voltage; and a ground pin to provide a path to ground.

15. The driver circuit of claim 14, wherein the multi-pin command interface comprises:

at least one data signal pin for receiving the driver control signal; and at least one clock signal pin for receiving a clock signal, wherein the control logic reads the at least one data signal pin synchronously with the clock signal.

16. The driver circuit of claim 14, wherein the multi-pin command interface comprises:

differential data signal pins for receiving the driver control signal as a differential signal, wherein the control logic includes a clock recovery circuit to recover a clock signal associated with the differential signal, and wherein the control logic reads the differential data signal pins synchronously with the recovered clock signal.

17. The driver circuit of 14, wherein the multi-pin command interface comprises:

differential data signal pins for receiving the driver control signal as a differential signal that encodes data in a clockless encoding format.

18. A driver circuit for a display device comprising:

control logic to operate in at least an addressing mode and an operational mode, wherein in the operational mode, the control logic obtains a driver control signal and controls a driver current to an LED zone based on the driver control signal, and the control logic further receives commands and outputs readback data responsive to the commands, and wherein in the addressing mode, the control logic obtains an incoming addressing signal, stores an address for the driver circuit based on the incoming addressing signal, and generates an outgoing addressing signal based on the incoming addressing signal;

an LED driving output pin to sink the driver current during the operational mode;

a data input pin to receive the incoming addressing signal during the addressing mode;

a serial data output pin to output the outgoing addressing signal during the addressing mode;

a parallel data output pin to output the readback data to a readback line;

a multi-pin command interface to receive the driver control signals from a control circuit via a multi-wire shared command interface;

a power pin to provide a supply voltage; and a ground pin to provide a path to ground.

19. The driver circuit of claim 18, wherein the multi-pin command interface comprises:

at least one data signal pin for receiving the driver control signal; and at least one clock signal pin for receiving a clock signal, wherein the control logic reads the at least one data signal pin synchronously with the clock signal.

20. The driver circuit of claim 18, wherein the multi-pin command interface comprises:

differential data signal pins for receiving the driver control signal as a differential signal, wherein the control logic includes a clock recovery circuit to recover a clock signal associated with the differential signal, and wherein the control logic reads the differential data signal pins synchronously with the recovered clock signal.

21. The driver circuit of claim 18, wherein the multi-pin command interface comprises:

differential data signal pins for receiving the driver control signal as a differential signal that encodes data in a clockless encoding format.

22. A driver circuit for a display device comprising:

control logic to operate in at least an addressing mode and an operational mode, wherein in the operational mode, the control logic obtains a driver control signal and controls a driver current to an LED zone based on the driver control signal, and the control logic further receives commands and outputs readback data responsive to the commands, and wherein in the addressing mode, the control logic obtains an incoming addressing signal, stores an address for the driver circuit based on the incoming addressing signal, and generates an outgoing addressing signal based on the incoming addressing signal;

a dual-purpose output pin to sink the driver current during the operational mode and to output the outgoing addressing signal during the addressing mode;

a data input pin to receive the incoming addressing signal during the addressing mode;

a parallel data output pin to output the readback data to a readback line;

a multi-pin command interface to receive the driver control signals from a control circuit via a multi-wire shared command interface;

a power pin to provide a supply voltage; and a ground pin to provide a path to ground.

23. The driver circuit of claim 22, wherein the multi-pin command interface comprises:

at least one data signal pin for receiving the driver control signal; and at least one clock signal pin for receiving a clock signal, wherein the control logic reads the at least one data signal pin synchronously with the clock signal.

24. The driver circuit of claim 22, wherein the multi-pin command interface comprises:

differential data signal pins for receiving the driver control signal as a differential signal, wherein the control logic includes a clock recovery circuit to recover a clock signal associated with the differential signal, and wherein the control logic reads the differential data signal pins synchronously with the recovered clock signal.

25. The driver circuit of claim 22, wherein the multi-pin command interface comprises:

differential data signal pins for receiving the driver control signal as a differential signal encoding data in a clockless encoding format.

* * * * *